US005860513A

United States Patent [19]

Suzuki

[11] Patent Number: 5,860,513

[45] Date of Patent: Jan. 19, 1999

[54] MATERIAL FOR FORMING CONTACT MEMBERS OF CONTROL SWITCH AND CONTROL SWITCH USING SAME

[75] Inventor: Satoshi Suzuki, Tochigi, Japan

[73] Assignee: The Furukawa Electric Co., Ltd., Tokyo, Japan

[21] Appl. No.: 866,960

[22] Filed: Jun. 2, 1997

[30] Foreign Application Priority Data

Jun. 7, 1996 [JP] Japan ..... 8-145703

[51] Int. Cl.[6] ..... H01H 1/02

[52] U.S. Cl. ..... 200/268; 200/269

[58] Field of Search ..... 200/268, 269, 200/262, 266

[56] References Cited

U.S. PATENT DOCUMENTS 1,904,241 4/1933 Kammerer ..... 200/269

4,138,604 2/1979 Harmsen et al. ..... 200/268

4,328,286 5/1982 Crosby ..... 200/268

4,339,644 7/1982 Aldinger et al. ..... 200/269

*Primary Examiner*—David J. Walczak

*Attorney, Agent, or Firm*—Frishauf, Holtz, Goodman, Langer & Chick, P.C.

[57] ABSTRACT

A material for forming contact members of a control switch, which has a structure including a primary layer made of Ni, Co, a Ni alloy or a Co alloy formed on a conductive base, and a surface layer made of Pd or a Pd alloy having a thickness of 0.001 to 0.4 $\mu$m which is formed on the primary layer. Such material exhibits good resistance to corrosion and adhesive wear. A control switch which is made using such material has a high operational reliability and a long service life.

20 Claims, 2 Drawing Sheets

PRIOR ART

MATERIAL FOR FORMING CONTACT MEMBERS OF CONTROL SWITCH AND CONTROL SWITCH USING SAME

BACKGROUND OF THE INVENTION

1. Field of the Invention

The present invention relates to material for forming contact members of a control switch and a control switch using same. More specifically, the invention relates to material for forming contact members of a control switch which has a small coefficient of dynamic friction, good resistance to heat, oxidation and corrosion, and good solderability, and a control switch formed of that material, thereby showing good resistance to adhesive wear and environmental influences.

2. Prior Art

A slide switch, a lever switch, a push switch, a tactile push switch, a dip switch and the like are known generally as a control switch. Each of those switches has a fixed contact member integrally composed of contact pieces and soldering terminals.

A tactile push switch, which belongs in those control switches, is shown in FIGS. 1 and 2. FIG. 2 is a sectional view taken along line II—II in FIG. 1.

As seen in FIGS. 1 and 2, the tactile push switch has a combination of a fixed contact member 1 and a movable contact member 2. The movable contact member is housed, for example, in a resin case 3 with a cover 4. A stem key is mounted thereon.

The fixed contact member 1 is integrally composed of soldering terminals 1*a* and contact pieces 1*b*. Conventionally, the fixed contact member is made of material having such formation that an Ag or Ag alloy layer having a thickness of approximately 0.5 to 20 μm is formed on a surface of a conductive base such as a brass base.

The movable contact member 2 is made of material having such formation that an Ag or Ag alloy layer is formed on a surface of a conductive base having a good spring property such as a phosphor bronze base.

The contact members are formed of material having an Ag or Ag alloy layer formed on the surface thereof, since Ag or Ag alloy has good resistance to corrosion and good solderability in addition to good electric characteristics.

In the aforementioned tactile push switch, the soldering terminals 1*a* of the fixed contact member 1 is constantly exposed to air. Therefore, for example, when the tactile push switch is stored, Ag at the surface of the soldering terminal 1*a* is sulfidized and/or chloridized due to S and/or Cl constituent in the air and solderability of the soldering terminal 1*a* is lowered, so that soldering of the tactile push switch becomes difficult. In order to solve those problems, countermeasures are taken such as applying a rust preventive to the soldering terminal 1*a*, or plating the soldering terminal 1*a* with solder.

However, even when the rust preventive is applied, the effect of the rust preventive is not sufficient in a bad environment, and solder plating is not industrially practical since it raises the production cost of switches. In the case of the movable contact member 2 which is housed in the case 3, problems caused by sulfidization or the like of its surface is less liable to occur. However, the surface containing Ag of the movable contact member 2 is brought into sliding contact with the surface containing Ag of the contact piece 1*b* of the fixed contact member 1. Therefore, with the passage of time, adhesive wear is generated, so that contact resistance is increased, and a force required for operating the switching action is increased. Thus, the function of the switch is deteriorated.

In order to prevent the aforementioned adhesive wear, countermeasures are taken such as applying contact oil to the surface of the contact piece of the fixed contact member and the surface of the movable contact member, or reducing contact pressure between those contact members. However, none of those countermeasures can prevent an increase in contact resistance and provide sufficient effects.

As described above, in the fixed contact member of control switch, which is integrally composed of the soldering terminals and the contact pieces, the soldering terminals need to have good resistance to environment and good solderability while the contact pieces need to be made of material which does not generate adhesive wear by contact with the counterpart member (the movable contact member) and does not generate an increase in contact resistance.

OBJECTS AND SUMMARY OF THE INVENTION

An object of the present invention is to provide material for forming contact members of a control switch which keeps good solderability even in a corrosive environment and is not liable to generate adhesive wear by contact with a counterpart member nor to generate an increase in contact resistance.

Another object of the present invention is to provide material for forming contact members of a control switch which can be easily produced by plating.

Still another object of the present invention is to provide a control switch using the aforementioned material thereby having high operational reliability and long lifetime.

In order to attain the aforementioned objects, the present invention provides material for forming contact members of a control switch comprising:

a conductive base;

a primary layer having any one of Ni, Co, Ni alloy and Co alloy as a main constituent and formed on the surface of the conductive base; and a surface layer having Pd or Pd alloy as a main constituent and formed on the primary layer with a thickness of 0.001 to 0.4 μm. (This material will be hereinafter referred to as "material A".)

The present invention also provides material for forming contact members of a control switch comprising:

a conductive base;

an intermediate layer made of any one of Ag, Ru, In, Sn, Sb, Bi, Pb, Zn and Cd formed on the surface of the conductive base; and a surface layer having Pd or Pd alloy as a main constituent and formed on the intermediate layer with a thickness of 0.001 to 0.4 μm. (This material will be hereinafter referred to as "material B".)

The present invention further provides material for forming contact members of a control switch having such formation that an intermediate layer made of any one of Ag, Ru, In, Sn, Sb, Bi, Pb, Zn and Cd is formed between the conductive base and the primary base according to the formation of material A. (This material will be hereinafter referred to as "material C".)

The present invention furthermore provides a control switch comprising:

a fixed contact member integrally composed of contact pieces and soldering terminals;

a movable contact member disposed opposite to the fixed contact member;

a case containing the fixed contact member and the movable contact member; and a key for operating the movable contact member, wherein the fixed contact member and/or the movable contact member is formed of any one of the aforementioned materials A, B and C.

DETAILED DESCRIPTION OF THE INVENTION

First, description will be made of material A of the present invention provided for forming contacts members of a control switch.

Figure 3:
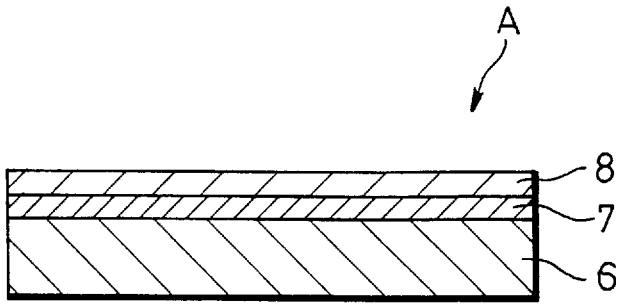
FIG. 3 is a sectional view showing layer structure of material A of the present invention.

FIG. 3 is a sectional view showing layer structure of material A. The material A has a primary layer 7 and a surface layer 8 formed in this order on the surface of a conductive base 6.

Since the surface layer 8 is to be exposed to air and to be brought into sliding contact with a counterpart member, it is desirable that the surface layer 8 has good resistance to corrosion and properties of not generating adhesive wear by contact with a counterpart member nor generating an increase in contact resistance.

In the material A of the present invention, the surface layer 8 is formed of Pd or Pd alloy such as Pd-Ni type, Pd-Co type, Pd-Ag type or Pd-Au type alloy as a main constituent, since each of those substances has good conductivity and good resistance to heat, oxidation and corrosion, and is less expensive than Au, which is otherwise the most desirable material for the surface layer.

The thickness of the surface layer 8 is determined to be 0.001 to 0.4 $\mu$m. If the thickness is smaller than 0.001 $\mu$m, the aforementioned good properties of Pd or Pd alloy do not fully show their effects. If the thickness is made larger than 0.4 $\mu$m, it only results in waste of expensive material since the effects of the aforementioned properties have already reached the saturated state. Moreover, when the material is worked into a predetermined shape, cracking may be produced in the surface layer due to such thickness. The more desirable thickness is 0.005 to 0.1 $\mu$m.

When Pd alloy is used for forming the surface layer 8, a desirable Pd concentration in the Pd alloy is 50% or more by weight, more particularly 70% or more by weight. If the Pd concentration in the alloy is less than 50% by weight, the aforementioned effects are difficult to be obtained.

The conductive base 6 of the material A may be made of any conductive material. For example, Cu, Ni, Fe or their alloys; brass; stainless steel; phosphor bronze; German silver; or cupronickel may be used. Composite material such as Cu- or Cu alloy-coated steel or aluminum may also be used.

The primary layer 7 is formed of any one of Ni; Co; Ni alloy such as Ni-Co, Ni-Fe, Ni-P and Ni-B; and Co alloy such as Co-Fe, Co-P and Co-B as a main constituent.

The primary layer 7 serves to prevent the metallic constituents of the aforementioned base 6 from diffusing into the surface layer 8 and contaminating its main constituent Pd, thereby lowering the resistance to corrosion of the surface layer 8. Therefore, by forming the primary layer 7 between the surface layer 8 and the base 6, the thickness of the surface layer 8 can be reduced, therefore, the used amount of relatively expensive Pd or Pd alloy can be reduced.

Moreover, the primary layer 7 serves to prevent corrosive gas constituents, oxygen and the like from diffusing from the outside through the surface layer 8 into the base 6, thereby to prevent corrosion and oxidation of the base 6.

The thickness of the primary layer 7 is not confined to any specific value. However, if the primary layer 7 is too thin, the aforementioned effects are not fully obtained, whereas if the primary layer 7 is too thick, the workability of the material A is lowered. The desirable thickness is 0.1 to 3.0 $\mu$m.

It is desirable that each of the aforementioned primary layer 7 and surface layer 8 is formed by plating, since it allows precise control of thickness, and it allows mass production using a continuous line, thereby lowering the production cost of the material A.

It is desirable that, after both the aforementioned primary layer 7 and the surface layer 8 are formed by plating, reduction and/or heat-treatment of the whole material is performed, since those processes serve to improve the properties of the material A desirable for forming contact members.

When the reduction is performed, adhesion between the base 6 and the primary layer 7 and between the primary layer 7 and the surface layer 8 is raised, and the upper surface of the surface layer 8 becomes very smooth, so that resistance to corrosion and heat, and solderability of the material A is improved.

If the reduction ratio is too low, the aforementioned properties are not so much improved. If the reduction ratio is too high, cracking may be generated in the layers formed by plating. The desirable reduction ratio is approximately 5 to 40%.

On the other hand, when the heat treatment is performed, metallic constituents of the base 6, the primary layer 7 and the surface layer 8 are caused to diffuse into the respective opposite layer or base in the vicinity of the respective interface, i.e., the interface between the base 6 and the primary layer 7 and the interface between the primary layer 7 and the surface layer 8, and to form their alloys in those interfacial areas. As a result, adhesion between the base 6 and the primary layer 7 and between the primary layer 7 and the surface layer 8 is raised, and resistance to heat, oxidation and corrosion is improved. Particularly, resistance to corrosion is improved, since plating additives and hydrogen occluded in the layers formed by plating are decomposed or released by the heat treatment.

The desirable temperature of the heat treatment is 300 ° to 800° C. If the temperature is lower than 300° C., it takes long time to obtain the aforementioned effects, so that productivity is lowered. If the temperature is higher than 800° C., and if the surface layer 8 is made of Pd alloy, Pd concentration in the surface layer becomes lower than 50% by weight and the aforementioned effects of Pd are lowered.

Though an atmosphere in which the heat treatment is performed is not confined to any specific one, a non-oxidizing atmosphere is desirable.

Figure 1:
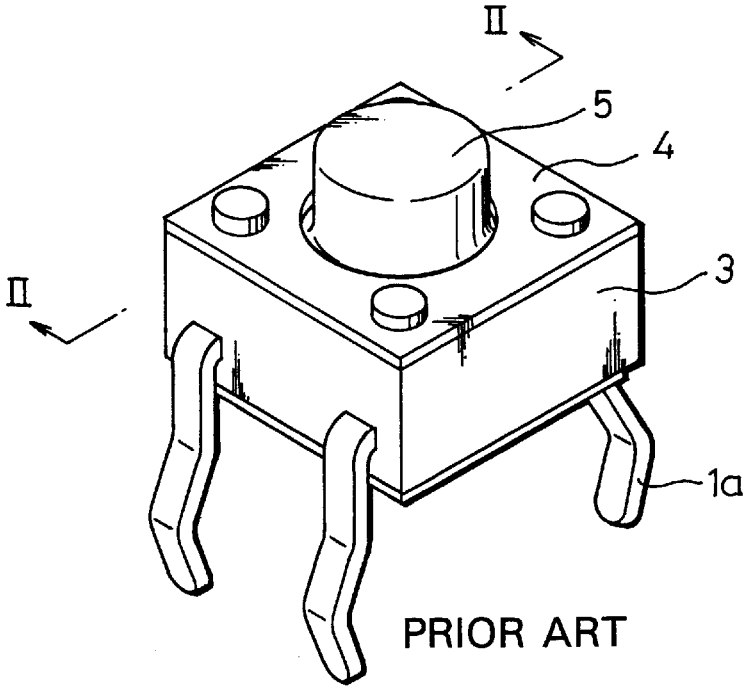
FIG. 1 is a perspective view of a tactile push switch.

After the layer structure shown in FIG. 1 is formed by plating, either the reduction or the heat-treatment may be performed independently. However, if the reduction and the heat-treatment are both performed, multiplication effects are obtained, so that those properties of the material A desirable for forming contact members are remarkably improved.

Next, description will be made of material B of the present invention provided for forming contact members of a control switch.

Figure 4:
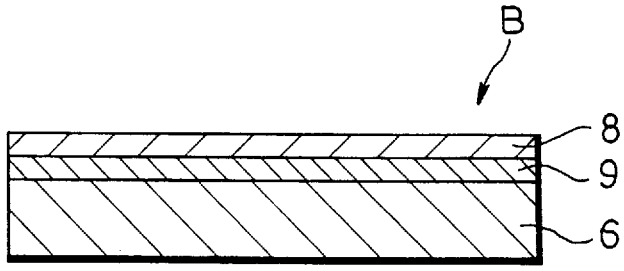
FIG.4 is a sectional view showing layer structure of material B of the present invention.

FIG. 4 is a sectional view showing layer structure of the material B.

The material B has such structure that an intermediate layer 9 is formed between the base 6 and the surface layer 8 of the material A in place of the primary layer 7 of the material A.

Like the primary layer 7 of the material A, the intermediate layer 9 serves to prevent the metallic constituents of the base 6 from diffusing from the base 6 into the surface layer 8, contaminating the surface layer 8 and thereby lowering resistance to corrosion of the surface layer 8.

The intermediate layer 9 is made of any one of Ag, Ru, In, Sn, Sb, Bi, Pb, Zn and Cd. Since alloys of those metals are fragile, if the intermediate layer 9 is made of any of those alloys, workability of the material is lowered and cracking or the like is liable to occur. Therefore, the intermediate layer 9 needs to be made of only any of the aforementioned metallic substances.

The desirable thickness of the intermediate layer 9 is 0.001 to 2.0 $\mu$m. If the thickness is smaller than 0.001 $\mu$m, the aforementioned effects are not obtained. If the thickness is made larger than 2.0 $\mu$m, it only results in waste of material since the aforementioned effects of the intermediate layer 9 have already reached the saturated state. Specifically, the desirable thickness is 0.003 to 0.05 $\mu$m in the case of expensive metals such as Ru and In, and 0.01 to 1.0 $\mu$m in the case of Ag, Sn, Sb, Bi, Pb, Zn and Cd.

The immediate layer 9 may be either a single layer or in itself composed of multiple sub-layers.

It is desirable that the intermediate layer 9 is formed by plating. After the layer structure shown in FIG. 4 is formed by plating, it is desirable that reduction and/or heat-treatment of the whole material is performed, as in the case of the aforementioned material A.

Next, description will be made of material C of the present invention provided for forming contact members.

Figure 5:
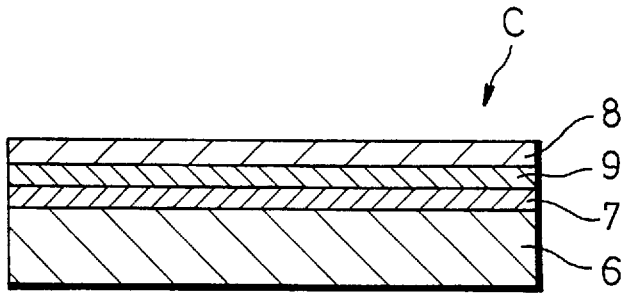
FIG. 5 is a sectional view showing layer structure of material C of the present invention.

FIG. 5 is a sectional view showing layer structure of the material C.

The material C has such structure that the aforementioned primary layer 7, the aforementioned intermediate layer 9 and the aforementioned surface layer 8, are formed in this order on the base 6. Namely, both the primary layer 7 and the intermediate layer 9 are formed between the base 6 and the surface layer 8.

As a result, the material C has a better resistance to corrosion and adhesive wear than the material A, in which only the primary layer 7 is formed between the base 6 and the surface layer 8, and the material B, in which only intermediate layer 9 is formed between the base 6 and the surface layer 8. Thus, the material C has an economical advantage, since the thickness of the surface layer 8 can be further reduced, keeping the desired resistance to corrosion and adhesive wear.

Examples 1 to 5, Comparative Examples 1 and 2 and a Conventional Example

Examples of the material A having the layer structure shown in FIG. 3 having no intermediate layer were produced as follows:

Electrolytic degreasing and acid pickling, which are known in themselves, were made to a base of brass having a thickness of 0.3 mm and a width of 30 mm. Then, the brass base was passed to a continuous plating line, where a primary layer and a surface layer as specified in Table 1 were formed in this order on the brass base.

Neither reducing nor heat-treatment was performed after the layers were formed by plating.

Dynamic friction coefficient, solderability before and after sulfidization test and contact resistance of each obtained material were measured according to the following specifications.

Dynamic friction coefficient ($\mu$k): Measurement is made using a movable piece of Ag-plated phosphor bronze bulged with 5R, under the following conditions: load . . . 90 mN, current . . . 10 mA, sliding distance . . . 10 mm, number of sliding actions . . .200 times.

Sulfidization test: Material is left for eight hours in an atmosphere having 3 ppm $H_2S$ and having a temperature of 40° C.

Solderability: Wet time and wet load of a sample of material having a width of 10 mm are measured using meniscography under the following conditions: used solder . . . 60% Sn-Pb, flux . . . 25% rosin/IPA, temperature . . . 230° C., immersion speed . . . 25 mm/sec, immersion depth . . . 8 mm, immersion time . . . 10 seconds.

Contact resistance: Measurement is made using a probe of pure Ag having a head of 5R under the following conditions: load . . . 98 mN, current . . . 20 mA.

Plating for forming respective layers was performed under the following conditions. The thickness of layers to be formed by plating was adjusted by varying the plating time.

(1) In the case of Ni plating

Plating bath: $NiSO_4$ . . . 240 g/L, $NiCl_2$ . . . 45 g/L, $H_3BO_3$ . . . 30 g/L.

Plating conditions: current density . . . 5 A/dm$^2$, bath temperature . . . 50° C.

(2) In the case of Co plating

Plating bath: $CoS0_4$ . . . 400 g/L, NaCl . . . 20 g/L, $H_3BO_3$ . . . 40 g/L.

Plating conditions: current density . . . 5 A/dM$^2$, bath temperature . . . 30° C.

(3) In the case of Pd plating

Plating bath: $Pd(NH_3)_2Cl_2$ . . . 40 g/L, $NH_4OH$ . . . 90 mL/L, $(NH_4)_2S0_4$ . . . 50 g/L.

Plating conditions: current density . . . 1 A/dM$^2$, bath temperature . . . 30° C.

(4) In the case of Pd-Ni alloy plating

Plating bath: $Pd(NH_3)_2Cl_2$. . .40 g/L, $NiSO_4$ . . . 45 g/L, $NH_40H$ . . . 90 mL/L, $(NH_4)_2S0_4$ . . . 50 g/L.

Plating conditions: current density . . . 1 A/dM$^2$, bath temperature . . . 30° C.

Pb-Ni alloy layer composed of 80% Pd by weight and 20% Ni by weight is formed by this plating.

(5) In the case of Ag plating

First, Ag strike plating is performed according to the following specifications:

Plating bath: AgCN . . . 5 g/L, KCN . . . 60 g/L, $K_2CO_3$ . . . 30 g/L.

Plating conditions: current density . . . 2 A/dM$^2$, bath temperature . . . 30° C.

Next, Ag plating is performed according to the following specifications:

Plating bath: AgCN . . . 50 g/L, KCN . . . 100 g/L, $K_2CO_3$ . . . 30 g/L.

Plating conditions: current density . . . 1 A/dM$^2$, bath temperature . . . 30° C.

The results of measurement are shown in Table 1.

TABLE 1

| | Layer structure | | | | Dynamic | Solderability | | | | Contact resistance (mΩ) | |
|---|---|---|---|---|---|---|---|---|---|---|---|
| | | | | | | Before Sulfidization test | | After Sulfidization test | | | |
| | Primary layer | | Surface layer | | friction | Wet | Wet | Wet | Wet | Before | After |
| | Kind of plating | Thickness (μm) | Kind of Plating | Thickness (μm) | coefficient (μk) | time (sec) | load (mN) | time (sec) | load (mN) | sulfidization test | sulfidization test |
| Example 1 | Ni | 0.5 | Pd | 0.001 | 0.3 | 1.5 | 9.8 | 5.2 | 3.9 | 4 | 20 |
| Example 2 | Ni | 0.5 | Pd | 0.01 | 0.4 | 1.3 | 10.8 | 4.0 | 4.9 | 4 | 15 |
| Example 3 | Ni | 0.5 | Pd | 0.1 | 0.4 | 1.2 | 12.7 | 2.4 | 6.8 | 3 | 8 |
| Example 4 | Ni | 0.5 | 80%Pd—20%Ni | 0.1 | 0.4 | 1.2 | 11.8 | 2.3 | 7.8 | 3 | 7 |
| Example 5 | Co | 0.5 | Pd | 0.4 | 0.4 | 1.1 | 14.7 | 2.3 | 7.8 | 3 | 8 |
| Comparative Example 1 | Ni | 0.5 | Pd | 0.6 | 0.4 | 1.2 | 12.7 | 2.4 | 6.8 | 3 | 8 |
| Comparative Example 2 | Ni | 0.5 | Pd | 0.005 | 0.2 | 1.5 | 7.8 | 7.2 | 2.0 | 3 | 80 |
| Conventional Example | Ni | 0.5 | Ag | 1.0 | 1.0 | 0.9 | 13.7 | >10 | −8.8 | 3 | 230 |

The following is clear from Table 1.

(1) From the comparison between the examples 1 to 4 of the material A of the present invention and the conventional example, it is clear that the examples 1 to 4 of the material A have a smaller dynamic friction coefficient, much better solderability after the sulfidization test and lower contact resistance than the conventional example, though the examples 1 to 4 and the conventional example have the same primary layer. Thus, it is clear that forming the surface layer of Pd or Pd alloy is effective.

(2) As is clear from the comparison between the examples 1 to 5 of the material A of the present invention and the comparative examples 1 and 2, the surface layer should have a thickness of 0.001 μm or more in order to ensure good solderability and restrain an increase in contact resistance. The comparison between the example 5 and the comparative example 1 shows, however, that even when the thickness of the surface layer is made larger than 0.4 μm, it does not have much effects on solderability and contact resistance. Therefore, from an economical point of view, the maximum thickness of the surface layer may be 0.4 μm.

Examples 6 and 7

Examples of the material B having the layer structure shown in FIG. 4 having an intermediate layer formed between a base and a surface layer were produced.

Electrolytic degreasing and acid pickling, which are known in themselves, were made to a base as specified in Table 2 having a thickness of 0.3 mm and a width of 30 mm. Then, the base was passed to a continuous plating line, where an intermediate layer and a surface layer as specified in Table 2 were formed in this order on the base.

Neither reducing nor heat-treatment was performed after the layers were formed by plating.

Dynamic friction coefficient, solderability before and after sulfidization test and contact resistance of each obtained example of material B were measured in the same manner as in the case of the aforementioned examples 1 to 5 of material A. The results of measurement are shown in Table 2.

TABLE 2

| | | Layer structure | | | | Dynamic | Solderability | | | | Contact resistance (mΩ) | |
|---|---|---|---|---|---|---|---|---|---|---|---|---|
| | | | | | | | Before sulfidization test | | After sulfidization test | | | |
| | | Intermediate layer | | Surface layer | | friction | Wet | Wet | Wet | Wet | Before | After |
| | Base | Kind of plating | Thickness (μm) | Kind of plating | Thickness (μm) | coefficient (μk) | time (sec) | load (mN) | time (sec) | load (mN) | sulfidization test | sulfidization test |
| Example 6 | Brass | Ag | 0.2 | Pd | 0.1 | 0.4 | 1.2 | 9.8 | 2.6 | 9.8 | 5 | 6 |
| Example 7 | Stainless steel | Ag | 0.1 | Pd | 0.1 | 0.5 | 1.2 | 10.8 | 5.5 | 4.9 | 3 | 30 |

As is clear from Tables 1 and 2, the material B has better solderability and lower contact resistance than the conventional example.

Examples 7 to 23

Examples of the material C having the layer structure shown in FIG. 5 were produced as follows.

Electrolytic degreasing and acid pickling, which are known in themselves, were made to a base of brass having a thickness of 0.3 mm and a width of 30 mm. Then, the brass base was passed to a continuous plating line, where a primary layer, an intermediate layer and a surface layer as specified in Table 3 were formed in this order on the aforementioned brass base.

In the case of example 11, after the layers were thus formed by plating, reducing was performed with a reduction ratio of 20%. In the case of example 22, after the layers were formed by plating, heat-treatment was performed with a temperature of 300° C. for 0.5 hours. In the case of example 23, after the layers were formed by plating, reduction was performed with a reduction ratio of 20% and a heat-treatment was performed with a temperature of 500° C. for 0.5 hours. In the other cases, neither reduction nor heat-treatment was performed after the layers were formed by plating.

Dynamic friction coefficient, solderability before and after sulfidization test and contact resistance of each obtained example of material C were measured in the same manner as in the case of the aforementioned example 1 of material A.

With respect to the examples 22 and 23, Pd concentration in the surface layer was also measured using Auger electron spectroscopy analysis.

Plating for forming respective intermediate layers was performed according to the following specifications.

(1) In the case of Ag plating
Same as in the case of the aforementioned conventional example.

(2) In the case of Ru plating
Plating bath: $RuNOCl_3.5H_2O$ . . . 10 g/L, $NH_2SO_3H$ . . . 15 g/L.
Plating conditions: current density . . . 1 A/dM$^2$, bath temperature . . . 60° C.

(3) In the case of In plating
Plating bath: $In(BF_4)_3$ . . . 250 g/L, $H_3PO_4$ . . . 15 g/L, $NH_4BF_4$ . . . 50 g/L.
Plating conditions: current density . . . 5 A/dM$^2$, bath temperature . . . 20° C.

(4) In the case of Sn plating
Plating bath: $SnSO_4$ . . . 100 g/L, $H_2SO_4$ . . . 50 g/L, β-naphthol . . . 1 g/L, glue 2 g/L.
Plating conditions: current density . . . 2 A/dM$^2$, bath temperature . . . 20° C.

(5) In the case of Sb plating
Plating bath: potassium antimonyl tartrate . . . 100 g/L, potassium sodium tartrate . . . 25 g/L, KOH . . . 15 g/L.
Plating conditions: current density . . . 4 A/dM$^2$, bath temperature . . . 20° C.

(6) In the case of Bi plating
Plating bath: Bismuth oxide . . . 40 g/L, alkylarylsulfonic acid . . . 100 g/L.
Plating conditions: current density . . . 2 A/dM$^2$, bath temperature . . . 30° C.

(7) In the case of Pb plating
Plating bath: $Pb(BF_4)_2$. . . 150 g/L, $HBF_4$ . . . 150 g/L, peptone . . . 3 g/L.
Plating conditions: current density . . . 5 A/dm$^2$, bath temperature . . . 20° C.

(8) In the case of Zn plating
Plating bath: $ZnSO_4$ . . . 350 g/L,$(NH_4)_2SO_4$ . . . 30 g/L.
Plating conditions: current density . . . 4 A/dm$^2$, bath temperature . . . 40° C.

(9) In the case of Cd plating
Plating bath: cadmium borofluoride . . . 250 g/L, borofluoric acid . . . 90 g/L.
Plating conditions: current density . . . 3 A/dm$^2$, bath temperature . . . 25° C.

The results of measurement are shown in Table 3.

TABLE 3

| | Examples 8 through 15 | | | | | | | |
|---|---|---|---|---|---|---|---|---|
| | 8 | 9 | 10 | 11 | 12 | 13 | 14 | 15 |
| Layer structure | | | | | | | | |
| Primary layer | | | | | | | | |
| Kind of plating | Ni | Ni | Co | Ni | Ni | Ni | Ni | Co |
| Thickness (μm) | 0.5 | 0.5 | 0.5 | 0.5 | 0.5 | 0.5 | 0.5 | 0.5 |
| Intermediate layer | | | | | | | | |
| Kind of plating | Ag | Ag | Ag | Ag | Ag | Ru | In | Sn |
| Thickness (μm) | 0.001 | 0.05 | 0.2 | 2.0 | 0.1 | 0.005 | 0.06 | 0.1 |
| Surface layer | | | | | | | | |
| Kind of plating | Pd | Pd | 80%Pd—20%Ni | Pd | Pd | Pd | Pd | Pd |
| Thickness (μm) | 0.1 | 0.1 | 0.1 | 0.1 | 0.001 | 0.1 | 0.1 | 0.1 |
| Dynamic frictoin coefficient (μk) | 0.4 | 0.5 | 0.5 | 0.5 | 0.5 | 0.3 | 0.3 | 0.4 |
| Solderability | | | | | | | | |
| Before sulfidization test | | | | | | | | |
| Wet time (sec) | 1.2 | 1.2 | 1.2 | 1.2 | 1.0 | 1.2 | 1.2 | 1.2 |
| Wet load (mN) | 14.7 | 7.8 | 11.8 | 11.8 | 13.7 | 11.8 | 12.7 | 10.8 |
| After sulfidization test | | | | | | | | |
| Wet time (sec) | 3.5 | 2.4 | 2.3 | 4.1 | 4.6 | 1.6 | 2.7 | 3.0 |
| Wet load (mN) | 4.9 | 6.9 | 7.8 | 6.9 | 5.9 | 7.8 | 6.9 | 5.9 |
| Contact Resistance (mΩ) | | | | | | | | |
| Before sulfidization test | 3 | 3 | 3 | 3 | 3 | 3 | 4 | 3 |
| After sulfidization test | 8 | 5 | 6 | 6 | 15 | 4 | 7 | 12 |

TABLE 3-continued

| Remarks | Reduction | | | | | | | |
|---|---|---|---|---|---|---|---|---|
| | Examples 16 through 23 | | | | | | | |
| | 16 | 17 | 18 | 19 | 20 | 21 | 22 | 23 |
| Layer structure | | | | | | | | |
| Primary layer | | | | | | | | |
| Kind of plating | Ni | Ni | Ni | Ni | Ni | 80% Pd—20% Ni | Ni | Ni |
| Thickness (μm) | 0.5 | 0.5 | 0.5 | 0.5 | 0.5 | 0.1 | 0.5 | 0.5 |
| Intermediate layer | | | | | | | | |
| Kind of plating | Sb | Bi | Pb | Zn | Cd | Ag | Ag | Ag |
| Thickness (μm) | 0.1 | 0.1 | 0.1 | 0.1 | 0.1 | 0.1 | 0.1 | 0.1 |
| Surface layer | | | | | | | | |
| Kind of plating | Pd | Pd | Pd | Pd | Pd | Pd | Pd | Pd |
| Thickness (μm) | 0.1 | 0.1 | 0.1 | 0.1 | 0.1 | 0.1 | 0.01 | 0.5 |
| Dynamic frictoin coefficient (μk) | 0.4 | 0.4 | 0.4 | 0.4 | 0.4 | 0.4 | 0.4 | 0.3 |
| Solderability | | | | | | | | |
| Before sulfidization test | | | | | | | | |
| Wet time (sec) | 1.3 | 1.2 | 1.2 | 1.4 | 1.2 | 1.1 | 1.3 | 0.9 |
| Wet load (mN) | 10.8 | 11.8 | 11.8 | 9.8 | 10.8 | 11.8 | 12.7 | 16.7 |
| After sulfidization test | | | | | | | | |
| Wet time (sec) | 3.2 | 2.9 | 3.5 | 4.1 | 3.0 | 2.8 | 1.8 | 1.7 |
| Wet load (mN) | 5.9 | 7.8 | 6.9 | 5.9 | 7.8 | 8.8 | 9.8 | 10.8 |
| Contact Resistance (mΩ) | | | | | | | | |
| Before sulfidization test | 3 | 3 | 4 | 4 | 3 | 3 | 3 | 3 |
| After sulfidization test | 17 | 8 | 10 | 13 | 9 | 11 | 10 | 3 |
| Remarks | | | | | | | Pd 60% by wt. heat treatment only | Pd 70% by wt. reduction and heat treatment |

From the comparison between the results in Table 3 and the results in Table 1, it is clear that the examples 8 to 23 of material C have resistance to corrosion equal to or better than those of the examples 1 to 7 of materials A and B. Particularly with respect to the example 23, of which reduction and heat-treatment were performed, it is found that contact resistance does not change before and after the sulfidization test. This means that the example 23 has excellent resistance to corrosion.

Figure 2:
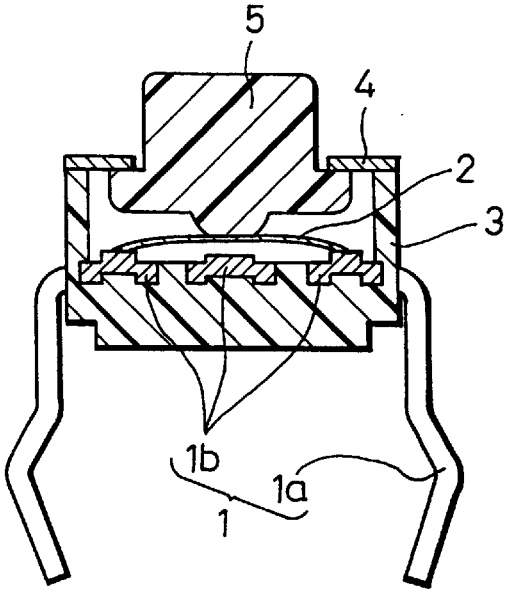
PRIOR ART FIG. 2
FIG. 2 is a sectional view taken along line II—II of FIG. 1.

Using the examples of materials according to the present invention, a fixed contact member and a movable contact member were formed, and a tactile push switch as shown in FIGS. 1 and 2 was constructed by use of those contact members. When thus constructed switch was practically used in an corrosive environment having 3ppm $H_2S$, the switch did not generate adhesive wear and showed good properties of contact members for a long time.

As described above, the material for forming contact members of a control switch according to the present invention has good resistance to corrosion, and is not liable to generate adhesive wear. Those effects are generated by the characteristics that the surface layer is a layer of Pd or Pd alloy having a thickness of 0.001 to 0.4 μm, and that the aforementioned primary layer or/and intermediate layer are formed between the surface layer and the conductive base. Since the aforementioned respective layers of the material can be formed by plating, the material is easy to produce.

Thus, the control switch using those materials of the present invention shows good properties of contact members, and has high operational reliability and long lifetime, so that it has a great industrial value.

What is claimed is:

1. A material for forming contact members of a control switch comprising:

a conductive base;

a primary layer made of a main constituent selected from the group consisting of Ni, Co, a, Ni alloy and a Co alloy and formed on a surface of said conductive base; and a surface layer made of a main constituent selected from the group consisting of Pd and a Pd alloy, and formed on said primary layer with a thickness of 0.001 to 0.4 μm.

2. A material for forming contact members of a control switch comprising:

a conductive base;

an intermediate layer made of an element selected from the group consisting of Ag, Ru, In, Sn, Sb, Bi, Pb, Zn and Cd, and formed on a surface of said conductive base; and a surface layer made of a main constituent selected from the group consisting of Pd and a Pd alloy, and formed on said intermediate layer with a thickness of 0.001 to 0.4 μm.

3. The material according to claim 2, wherein said intermediate layer and said surface layer are layers formed by plating.

4. A control switch comprising:

a fixed contact member integrally comprising contact pieces and soldering terminals;

a movable contact member disposed opposite to said fixed contact member;

a case containing said fixed contact member and said movable contact member; and a key for operating said movable contact member, wherein at least one of said fixed contact member and said movable contact member is formed of material according to claim 3.

5. The material according to claim 3, wherein said layers formed by plating are subjected to a treatment selected from the group consisting of at least one of a reduction and a heat-treatment at a temperature of 300° to 800° C.

6. A control switch comprising:

a fixed contact member integrally comprising contact pieces and soldering terminals;

a movable contact member disposed opposite to said fixed contact member;

a case containing said fixed contact member and said movable contact member; and a key for operating said movable contact member, wherein at least one of said fixed contact member and said movable contact member is formed of material according to claim 5.

7. A control switch comprising:

a fixed contact member integrally comprising contact pieces and soldering terminals;

a movable contact member disposed opposite to said fixed contact member;

a case containing said fixed contact member and said movable contact member; and a key for operating said movable contact member, wherein at least one of said fixed contact member and said movable contact member is formed of material according to claim 2.

8. The material according to claim 1, further comprising an intermediate layer made of an element selected from the group consisting of Ag, Ru, In, Sn, Sb, Bi, Pb, Zn and Cd, and formed between said conductive base and said surface layer.

9. A control switch comprising:

a fixed contact member integrally comprising contact pieces and soldering terminals;

a movable contact member disposed opposite to said fixed contact member;

a case containing said fixed contact member and said movable contact member; and a key for operating said movable contact member, wherein at least one of said fixed contact member and said moveable contact member is formed of material according to claim 8.

10. The material according to claim 1, wherein said primary layer and said surface layer are layers formed by plating.

11. A control switch comprising:

a fixed contact member integrally comprising contact pieces and soldering terminals;

a movable contact member disposed opposite to said fixed contact member; a case containing said fixed contact member and said movable contact member; and a key for operating said movable contact member, wherein at least one of said fixed contact member and said movable contact member is formed of material according to claim 10.

12. The material according to claim 10, wherein said layers formed by plating are subjected to a treatment selected from the group consisting of at least one of a reduction and a heat-treatment at a temperature of 300° to 800° C.

13. A control switch comprising:

a fixed contact member integrally comprising contact pieces and soldering terminals;

a movable contact member disposed opposite to said fixed contact member;

a case containing said fixed contact member and said movable contact member; and a key for operating said movable contact member, wherein at least one of said fixed contact member and said movable contact member is formed of material according to claim 12.

14. A control switch comprising:

a fixed contact member integrally comprising contact pieces and soldering terminals;

a movable contact member disposed opposite to said fixed contact member;

a case containing said fixed contact member and said moveable contact member; and a key for operating said movable contact member, wherein at least one of said fixed contact member and said movable contact member is formed of the material according to claim 1.

15. The material according to claim 1, wherein the surface layer has a thickness of 0.005 to 0.1 $\mu$m.

16. The material according to claim 15, wherein the conductive base is made of Cu, Ni, Fe, a Cu alloy, a Ni alloy, an Fe alloy, brass, stainless steel, phosphor bronze, German steel, cupronickel, Cu alloy-coated steel or aluminum.

17. The material according to claim 16, wherein the primary layer is made of Ni, Co, a Ni-Co alloy, a Ni-Fe alloy, a Ni-P, Ni-B, a Co-Fe alloy, Co-P or Co-B, and said primary layer has a thickness of 0.1 to 3.0 $\mu$m.

18. The material according to claim 1, wherein the surface layer consists essentially of Pd or a Pd alloy containing 50% by weight or more of Pd.

19. The material according to claim 1, wherein the surface layer consists essentially of Pd or a Pd-Ni alloy containing 70% by weight or more of Pd.

20. A material for forming a contact member of a control switch consisting essentially of:

(a) a conductive base, (b) a primary layer formed on a surface of the conductive base, said primary layer made of a main constituent selected from the group consisting of Ni, Cu, a Ni alloy and a Cu alloy, and (c) a surface layer made of a main constituent selected from the group consisting of Pd and a Pd alloy, said Pd alloy contains 50% by weight or more of Pd, said surface layer being formed on said primary layer, and said surface layer having a thickness of 0.001 to 0.4 $\mu$m.

* * * * *